US006176471B1

(12) United States Patent
Naegele et al.

(10) Patent No.: US 6,176,471 B1
(45) Date of Patent: Jan. 23, 2001

(54) FABRIC FENCE SYSTEM AND METHOD OF MANUFACTURING SAME

(75) Inventors: Charles Naegele, Clarks Summit; James F. Loven, Scranton, both of PA (US)

(73) Assignee: Allied Carefree Fence Systems, Inc., Clarks Summit, PA (US)

( * ) Notice: Under 35 U.S.C. 154(b), the term of this patent shall be extended for 0 days.

(21) Appl. No.: 09/282,819

(22) Filed: Mar. 31, 1999

(51) Int. Cl.[7] ..... E04H 17/16

(52) U.S. Cl. ..... 256/24; 256/47; 256/53; 256/32; 256/55; 256/65; 256/69

(58) Field of Search ..... 256/24, 32, 34, 256/47, 48, 50, 51, 55, 65, 69

(56) References Cited

U.S. PATENT DOCUMENTS

| | | | | |
|---|---|---|---|---|
| 430,177 | | 6/1890 | Elliott et al. . | |
| 486,752 | * | 11/1892 | Bonnaffon | 256/45 |
| 960,340 | * | 6/1910 | Kimball | 256/45 |
| T964,001 | * | 11/1977 | Ferwerda | 52/637 |
| 1,147,409 | * | 7/1915 | Krawczyk | 256/24 |
| 1,979,866 | | 11/1934 | Chapman . | |
| 2,073,182 | | 3/1937 | Scherer . | |
| 2,723,107 | * | 11/1955 | Parker | 256/24 |
| 2,826,394 | * | 3/1958 | Pinson | 256/32 |
| 2,836,397 | | 5/1958 | Morrissey . | |
| 2,976,021 | | 3/1961 | Stefan . | |
| 3,129,965 | * | 4/1964 | Stark | 256/65 X |
| 3,166,299 | | 1/1965 | De Chellis . | |
| 3,410,527 | | 11/1968 | Uroshevich . | |
| 3,875,623 | | 4/1975 | Johnston . | |
| 3,997,144 | * | 12/1976 | Parisien | 256/32 |
| 4,132,390 | * | 1/1979 | Pfarr, Jr. | 256/24 |
| 4,270,737 | | 6/1981 | Binns et al. . | |
| 4,372,992 | * | 2/1983 | Long | 427/185 |
| 4,492,364 | | 1/1985 | Boyanton . | |
| 4,497,472 | | 2/1985 | Johnson . | |
| 4,508,320 | | 4/1985 | Hegarty . | |
| 4,690,384 | * | 9/1987 | Palmer | 256/24 |
| 4,883,257 | | 11/1989 | Bracken . | |
| 4,907,783 | * | 3/1990 | Fisk et al. | 256/32 |
| 4,964,619 | | 10/1990 | Glidden, Jr. . | |
| 5,029,819 | | 7/1991 | Kane . | |
| 5,039,065 | | 8/1991 | Denton . | |
| 5,110,094 | * | 5/1992 | Kruse | 256/47 |
| 5,307,598 | * | 5/1994 | West | 52/155 |
| 5,328,156 | | 7/1994 | Hoke . | |
| 5,402,988 | * | 4/1995 | Eisele | 256/45 X |
| 5,577,714 | * | 11/1996 | Venegas, Jr. | 256/65 |
| 5,615,866 | * | 4/1997 | Kinnison | 256/1 |
| 5,758,868 | | 6/1998 | Shea . | |
| 5,799,929 | | 9/1998 | Meglino et al. . | |
| 6,041,486 | * | 4/2000 | Forbis | 256/24 X |
| 6,076,448 | * | 6/2000 | Rexroad | 256/45 X |

FOREIGN PATENT DOCUMENTS

| | | | | |
|---|---|---|---|---|
| 110070 | * | 3/1899 | (DE) | 256/24 |
| 10935 | * | of 1884 | (GB) | 256/24 |

* cited by examiner

*Primary Examiner*—Lynne H. Browne
*Assistant Examiner*—Ernesto Garcia
(74) *Attorney, Agent, or Firm*—Ratner & Prestia

(57) ABSTRACT

A fabric fence system and method of manufacturing the fabric fence system is disclosed. The fence system has posts that are laterally spaced from one another with a fence fabric position between the posts. The fence fabric has end protrusions that are inserted into the sides of the fence posts and held in place by a rod inserted into the hollow inner portion of the post such that the rod engages the protrusions of the fence fabric. The slots that accommodate the fence fabric are set at an angle relative the length of the post. The fence system also includes top and bottom cross members into which the top and bottom portion of the fence fabric are inserted and attached to provide a panelized fence system.

27 Claims, 9 Drawing Sheets

FABRIC FENCE SYSTEM AND METHOD OF MANUFACTURING SAME

FIELD OF THE INVENTION

This invention relates generally to fence systems. More specifically, the present invention relates to a fence system that combines polymer structural components with a fence fabric to form fence panels.

BACKGROUND OF THE INVENTION

Wire mesh fences, also commonly called chain link fences, are widely utilized throughout the country today. The fences are strong and consist of metal fence posts to which wire mesh is attached.

To install a chain link fence, the fence post is first installed, customarily by encasing it in concrete below ground level. The chain link fabric is stretched taut between posts and the fabric is attached to the post by the bands. Additionally, tension bands and stretcher bars may be included. Intermediate support, if needed, is provided by additional posts, commonly referred to as line posts. In addition, brace assemblies are required in some fence applications and these assemblies occur at the terminal posts.

There are, however, many disadvantages to conventional chain link fencing systems. Chief among these is the problem of attaching fence fabric to the fence post. These conventional methods employ a multitude of small parts including tension bands, brace bands, stretcher bars and assorted nuts and bolts. The tension bands are inserted into the end of the mesh and attached to the exterior of the post using the bands, nuts and bolts. Along the length of the fence mesh the mesh must be attached to the cross members using several ties (typically metal) to prevent the mesh from sagging. The ties are bent partially around the cross bar and each end is twisted around a strand of the fence material to secure the material to the cross bar and to intermediate posts. The ends of the wire ties are sharp and occasionally pose a safety hazard to those that come in contact with these exposed ends.

Thus, the installation of these fences is performed almost universally by professionals, and is relatively expensive because of the labor involved and the multitude of parts that the installer must inventory.

In an effort to simplify installation by reducing the parts needed, some proposals have been made to interweave wire meshing with the post itself. U.S. Pat. No. 3,410,527 to Uroshevich is an example of this application. Another is Ashworth et al., U.S. Pat. No. 3,370,836. These references, however, have not truly solved the problem. It has been found that the interweaving of the chain link fencing mesh is difficult because of the inherent strength of the material, and that the finished job has frequently stretched the metal into an unsightly appearance.

There are several other patents which disclose other fence systems which purport to including means for easy assembly.

Engstrom, U.S. Pat. No. 751,622 discloses a fence post having a recessed area for receiving a clamping rod. The clamping rod is held in place by a plurality of eye-bolts through the eyes of which the clamping rod extends. Tightening of the nut of the eye-bolt draws the clamping rod into the recess, bending and clamping the wire runners therein.

Jones, U.S. Pat. No. 1,150,373 discloses a tubular fence post having retaining leaves struck outwardly to provide spaces between the respective retainers and the body of the tubular post. After the wires are in position, a key or holder is inserted through the spaces to hold the wire in place. The post shown is an intermediate post, not an end, corner or gate post, for a rectangular grid wire fence. The post is not designed for use as an end, corner or gate post and does not provide a recessed and protected connection.

Gerken, U.S. Pat. No. 1,160,709 discloses a fence post having extending hooks and tongues for receiving a tie or retaining rod. The posts are intermediate posts, not end, corner, or gate posts, and do not provide a recess to receive and protect the rod.

James, U.S. Pat. No. 1,330,809 discloses a metallic fence post (intermediate post, not an end, corner, or gate post) which has depressed or concave grooved sections between straps or bands. The straps are used to secure single strand fencing, e.g. barbed wire fencing, by hog-ring clips and are not used for chain link fencing.

Ashworth et al. U.S. Pat. No. 3,370,836 discloses a chain link fence having an end, corner, or gate post or corner post with expanded strips providing apertures with the same spacing as the fence links. The end links of the fence are secured to the apertures provided by the expanded strips by a serpentine wire interconnecting the end links thereto.

Bishop, U.S. Pat. No. 3,502,303 discloses an intermediate (not an end, corner, or gate post) fence post having horizontal slots for receiving individual wires of single strand wire fencing. A locking rod or wire is vertically extended between the wires and the interior of the post to hold them in place.

Muckelrath, U.S. Pat. No. 4,058,882 discloses a metal post of angle iron or hollow square construction having holes punched along the corners thereof. The posts are intermediate posts for wire fencing comprising a plurality of separate single strands. A retaining tie wire is placed through the hole after engagement with each individual fence wire and twisted to hold the wire in place.

SUMMARY OF THE INVENTION

In view of the shortcomings of the prior art, it is an object of the present invention to provide a fence system that offers ease of installation; is easily packaged for resale stocking and portability; is an attractive improvement over standard chain link fence; requires less parts than conventional chain link fence systems; requires less maintenance than conventional chain link fence systems; provides more security than typical rigid PVC fence or conventional chain link fence systems.

The fence system comprises a first post and a second post laterally spaced from one another by a predetermined distance, each post having i) a hollow portion along a length of the post, ii) a first lower slot and a first upper slot in a first side portion of the post, the first lower slot and the first upper slot substantially parallel to the length of the post, and iii) a first plurality of slots disposed between the first lower slot and the first upper slot in the first side portion of the post, the plurality of slots set at an angle with respect the length of the post; a first cross member coupled between the first lower slot of the first post and the first lower slot of the second post; a second cross member coupled between the first upper slot of the first post and the first upper slot of the second post; a fabric extending between the first post and the second post, the fabric having a plurality of projections at a first end of the fabric and a second end of the fabric, each of the plurality of projections extending through a respective one of the plurality of third slots disposed in the first post and the second post; and a retainer inserted through each of the plurality of projections at least a first end of the fabric to couple the fabric to an inside portion of at least the first post.

The present invention also discloses a method for fabricating a fence panel. The method comprises the steps of providing a first post and a second post, each post having a hollow portion; forming a lower slot and an upper slot in a side portion of the post, the lower slot and the upper slot substantially parallel to the length of the post; forming a first plurality of slots disposed between the lower slot and the upper slot in the side portion of the post, the plurality of slots set at an angle with respect the length of the post; coupling a first cross member between the lower slot of the first post and the lower slot of the second post; extending a fabric between the first post and the second post, the fabric having a plurality of projections at a first end of the fabric and a second end of the fabric; inserting each of the plurality of projections of the fabric through a respective one of the plurality of third slots disposed in the first post and the second post; inserting a retainer through each of the plurality of projections at least the first end of the fabric to couple the fabric to an inside portion of at least the first post; and coupling a second cross member between the upper slot of the first post and the upper slot of the second post.

According to another aspect of the invention, the fence fabric is attached to an inside portion of the upper and lower cross members.

According to still another aspect of the invention, adjacent cross members are attached to one another through a coupling plate.

According to yet another aspect of the present invention, the retainer passes through a top portion of the lower cross member and captures the lower cross member within the post.

According to a further aspect of the present invention, the retainer is a metallic or polymer circular rod.

According to still another aspect of the invention, the cross members include a slot into which the fabric is inserted.

These and other aspects of the invention are set forth below with reference to the drawings and the description of exemplary embodiments of the invention.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures.

DETAILED DESCRIPTION

Figures 1A, 1B, 1C:
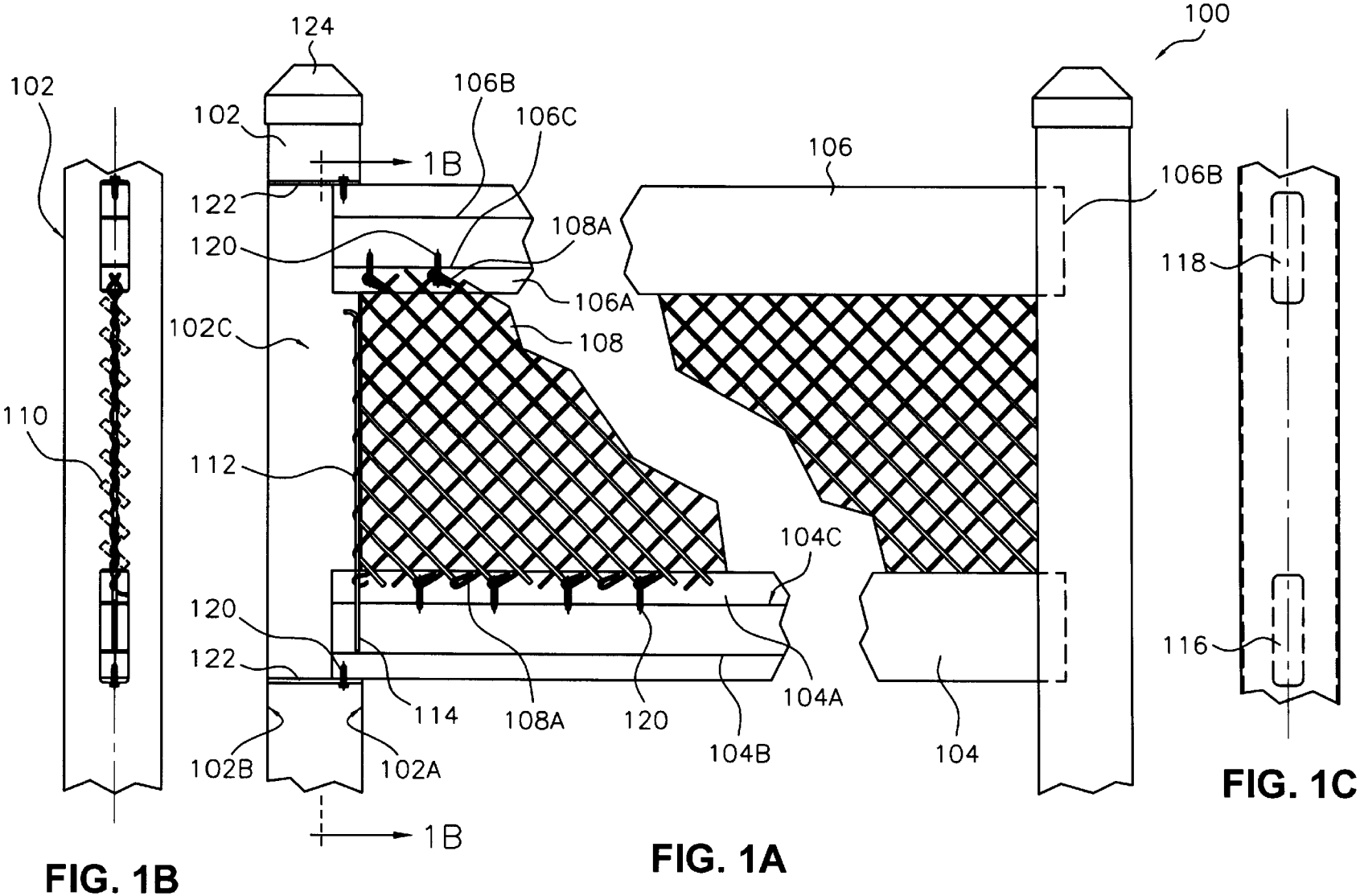
FIGS. 1A–1C are various views of a portion of a fence system according to a first exemplary embodiment of the present invention.

FIG. 1A illustrates a section of the fence system according to a first exemplary embodiment of the present invention. In FIG. 1A, fence system 100 is formed from posts 102, spaced apart from one another by a predetermined distance. This distance may be determined according to a variety of factors, such as the terrain at the installation site, customer requirements, industry standards and packaging considerations. The posts 102 may be made from a rigid polymer material such as PVC and may have a rectangular or square or substantially circular cross section. The post 102 has a hollow potion 102C to accommodate the cross members and fence fabric discussed more fully below.

Lower cross member 104 is inserted into slots 116 (shown in FIG. 1C) formed at a bottom portion of each post 102. Fence fabric 108, which may be a polymer coated chain link fence material is positioned between posts 102 and within slot 104A of lower cross member 104. In addition, the polymer may be a vinyl coating.

As more clearly shown in FIG. 1B, the posts 102 have a plurality of slots 110 cut into at least one side of the post 102. End portions or "elbows" 112 of the fence fabric 108 are inserted into the slots 110 to protrude into the hollow portion 102C of post 102. Slots 110 may be sized in accordance with the gage of the fence fabric 108 and are spaced to match the spacing between each of the elbows 112 of fence fabric 108.

A retainer rod 114 is inserted through the top opening of the post and slides through the inside of the protruded "elbows" to retain the chain link fence to the post. Retainer 114 may be a polymer rod, a vinyl coated metallic rod, or a non-coated metallic rod. The retainer 114 may also be used to retain the lower cross member 104 to the post 102 by insertion of the rod through the top portion of lower cross member 104.

To complete the frame assembly of fence 100 the upper cross member 106 is inserted through the top slots 118 formed at the upper portion of posts 102. The cross member 106 may be inserted into slots 118 by sliding one end of upper cross member 106 into the first post 102 until the end 106B of cross member 106 is clear to be inserted into the second slot 118.

The upper portion of the fence fabric 108 may also be inserted into a slot 106A formed in upper cross member 106. The upper and lower portions 108A of fence fabric 108 may be fixed to the upper and lower cross members 104, 106 with fasteners 120, which may be self tapping screws or rivets for example. The fasteners 120 pass through the upper or lower portion 108A of fence fabric 108 and into support member 104C, 106C (shown in FIG. 2) of cross members 104, 106, respectively.

Figure 2:
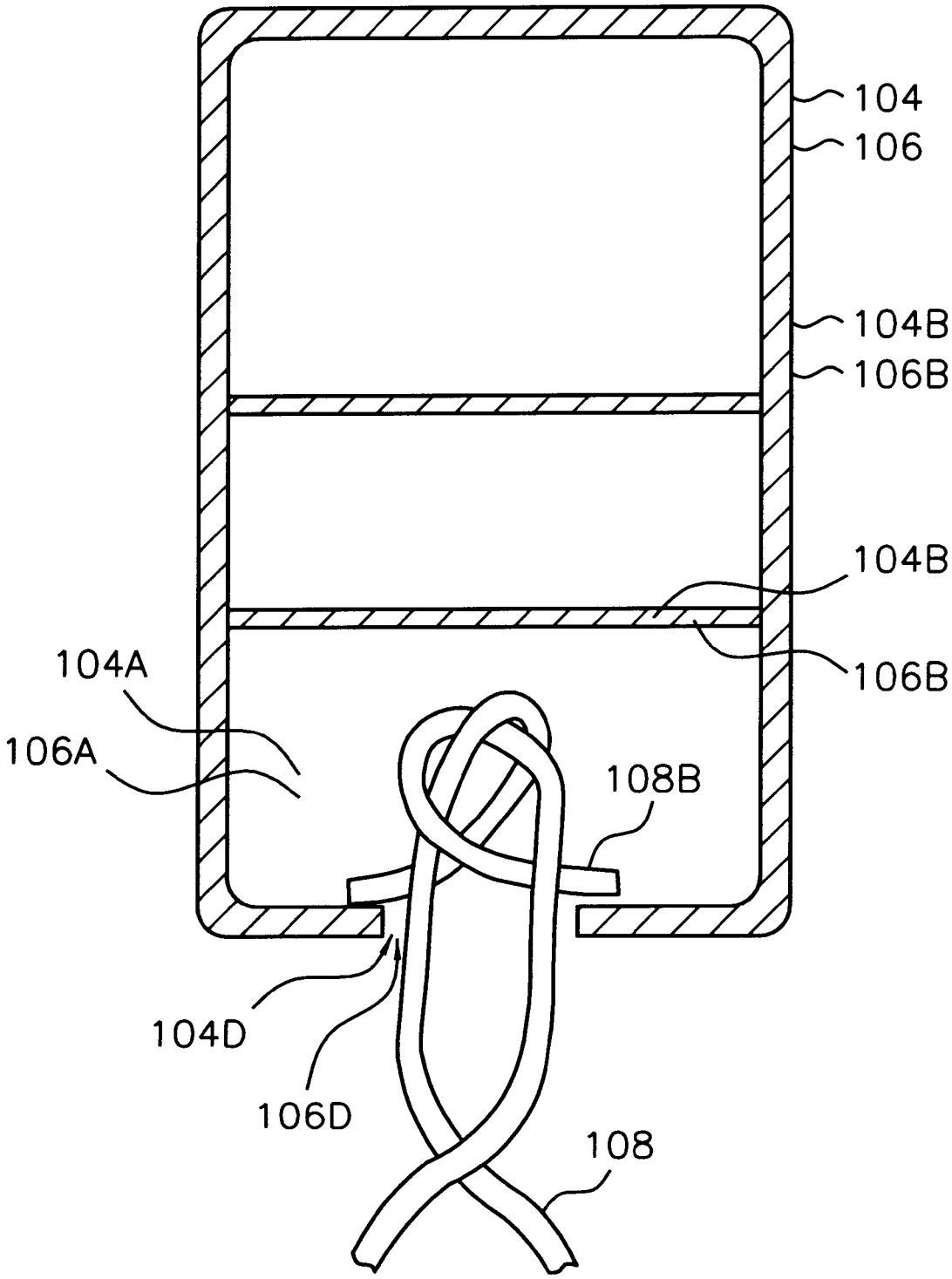
FIG. 2 is cross sectional view of a cross member of the exemplary embodiment of FIGS. 1A–1C.

FIG. 2 is a second exemplary embodiment of the present invention. In FIG. 2, a cross-section of upper or lower cross members 104, 106 is shown. The cross members include support members 104B, 104C, 106B, 106C integrally formed within cross member 104, 106, respectively. These support members 104B, 104C, 106B, 106C provide rigidity both torsionally and laterally to the cross members and forms the slot 104A, 106A mentioned above. As an alternative to fastening fence fabric 108 with fasteners 120 to cross member 104, 106, the fence fabric may be formed with a modified "knuckle" 108B at one or both of the upper and lower portions of the fence fabric 108. The knuckle 108B may be inserted into slot 104A, 106A by sliding the fence fabric 108 along slot 104A, 106A. The opening 104D, 106D in the cross member 104, 106 is dimensioned according to the thickness of the fence fabric 108 such that the fence fabric 108 fits snuggle within opening 104D, 106D.

The knuckles 108B of the fence fabric 108 may be bent past the point where they would be aligned to form a curled end. The spring of the fence fabric 108 permits the curl to straighten as the knuckles are pushed into the slot 104A, 106A. After the knuckles are inserted into the slot 104A, 106A any force exerted to pull the fence fabric 108 out of the slot 104A, 106A will be countered by the curled end of the knuckle 108B acting on the inner surface of the cross member 104, 106. The fence fabric is thus locked into the slot 104A, 106A without the need for auxiliary fasteners. The assembly of the fence 100 may then proceed as discussed above in the first exemplary embodiment.

Referring back to FIG. 1, the structural integrity of fence 100 may be enhanced by attaching coupling plate 122 to the upper or lower cross members 104, 106 using fastener 120. The details of the coupling plate 122 are shown with reference to FIG. 5.

Figure 5:
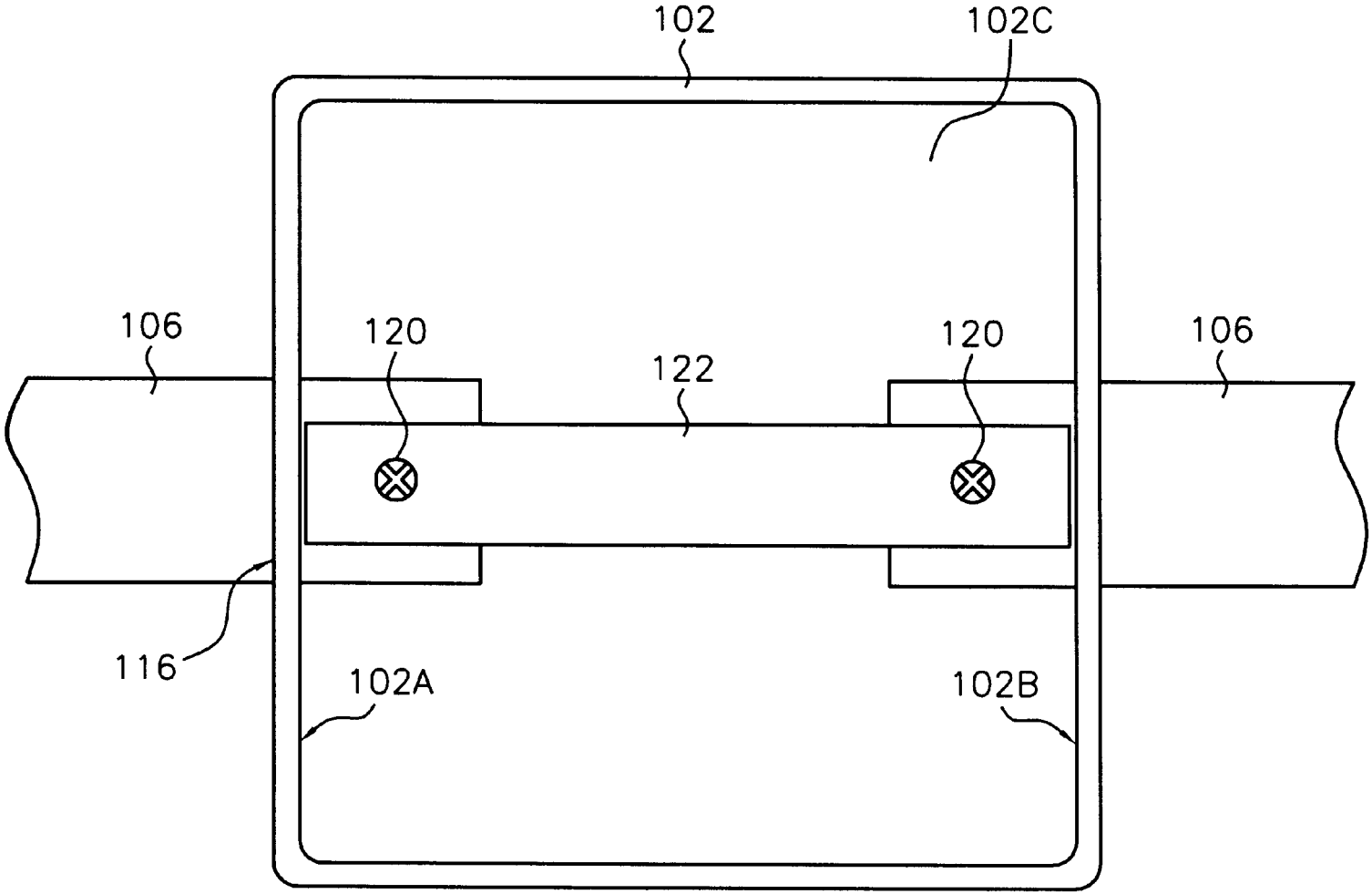
FIG. 5 is a cross-sectional end view of an intermediate post of the present invention detailing coupling between adjacent fence sections.

As shown in FIG. 5, the coupling plate 122 fits within the hollow portion 102C of post 102 and preferably snuggly between opposite walls 102A and 102B of post 102. Once attached with fasteners 120, coupling plate 122 prevents cross members 104, 106 from moving within slots 116, 118.

Referring again to FIG. 1, to complete the assembly, a cap 124 may be placed on the end of post 102 to prevent moisture and debris from entering post 102 and to provide a finished appearance.

Although not illustrated in FIG. 1, it is understood that additional sections of fence 100 may be constructed in a linear or orthogonal manner to form an enclosure (not shown).

Figure 6:
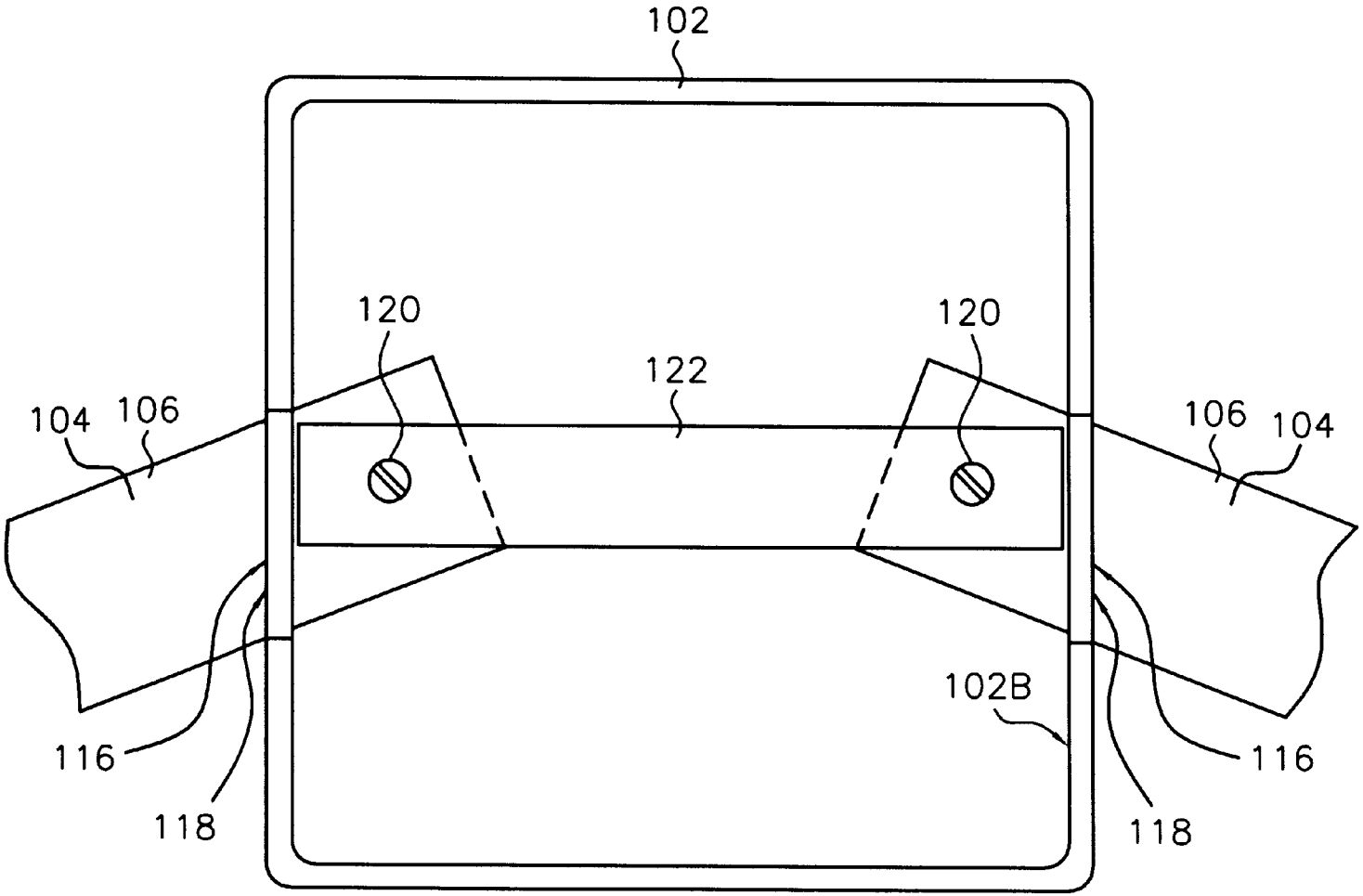
FIG. 6 is a cross-sectional end view of an intermediate post of according to another exemplary embodiment of the present invention.

Referring to FIG. 6, it is also contemplated that adjacent fence sections may be set at a variety of angles by enlarging the slots 116, 118 in post 102 such that the upper cross member 106 and lower cross member 104 may be disposed in post 102 at an angle. The coupling plate 122 may also be used to secure the additional fence sections as is understood by one of ordinary skill in the art.

Figure 3C:
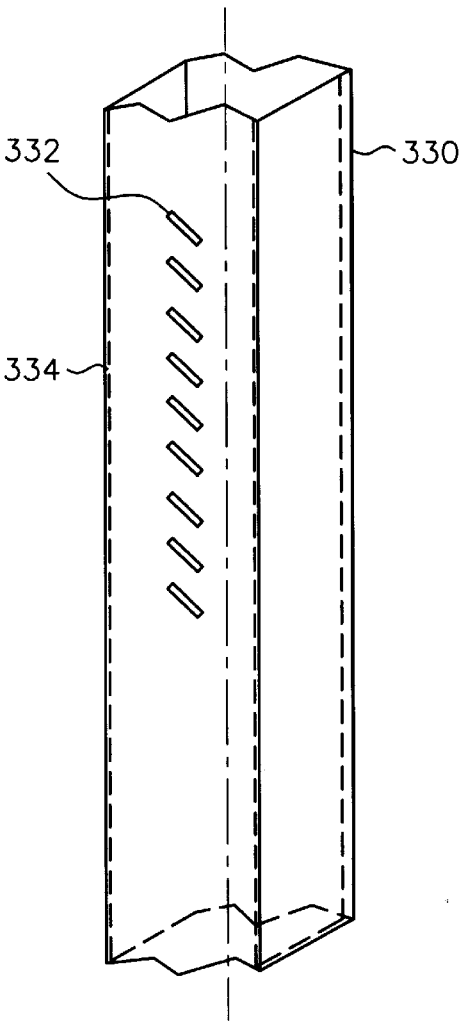
FIGS. 3A–3F are illustrations of end, corner and intermediate posts of the first exemplary embodiment of the present invention.
Figure 3B:
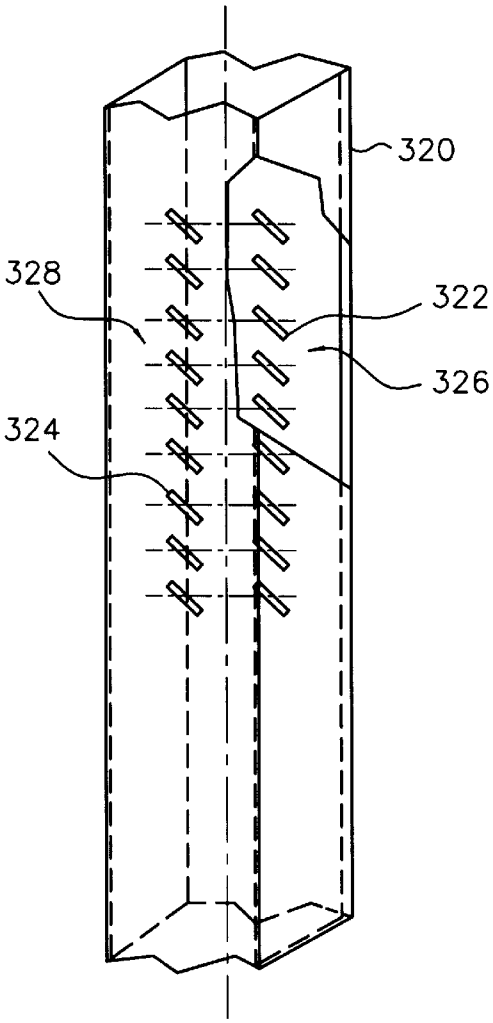
Figure 3A:
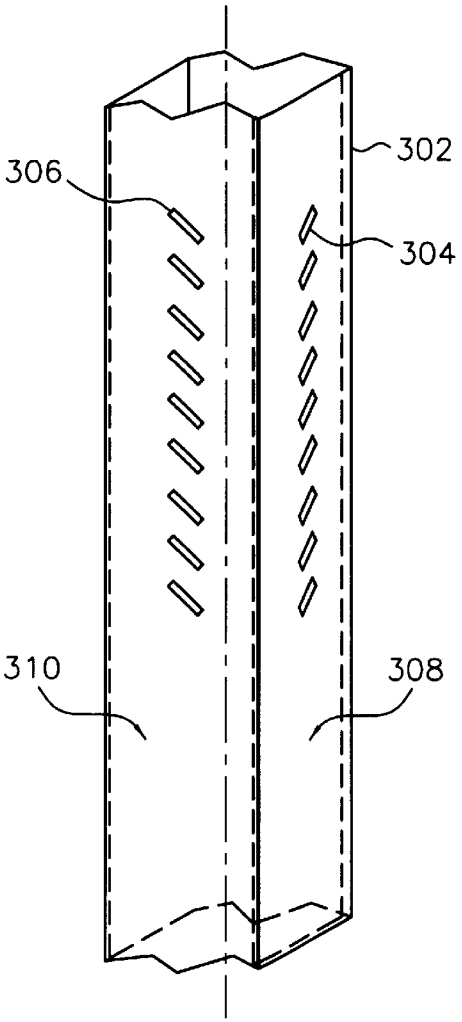

FIGS. 3A–3C are exemplary embodiments of posts 102 of the present invention. Although the posts depicted in FIGS. 3A–3C have essentially square or rectangular cross-sections, it is understood that the posts 102 may also have a circular cross section to accommodate irregular shaped (i.e. non-orthogonal) site conditions (see FIG. 7). It may also be desirable to present different esthetics.

FIG. 3A illustrates a corner post 302, which has slots 304, 306 formed within immediately adjacent side walls 308, 310, respectively. The angle of slots 304, 306 are determined based on the angle of the elbows 112 of fence fabric 108 (shown in FIG. 1). Preferably the angle of slots 304, 306 may between about 30° and 60° and preferably between about 40° and 50°, and most preferably about 45°. In addition, slots 304, 306 may have a downward slope to the right or to the left depending on the fence fabric 108.

FIG. 3B illustrates a line post 320 in which slots 322, 324 are formed in opposite walls 326, 328, respectively.

FIG. 3C illustrates an end post 330 in which slots 332 are formed in only one wall 334. End post 330 may also be used as a transition between the fence system and a gate system (not shown). Although not illustrated in FIGS. 3A–3C, it is understood that in addition to the slots to accommodate the fence fabric 108, slots 116, 118 are also formed in the respective posts below and above each set of slots, respectively.

Figure 3F:
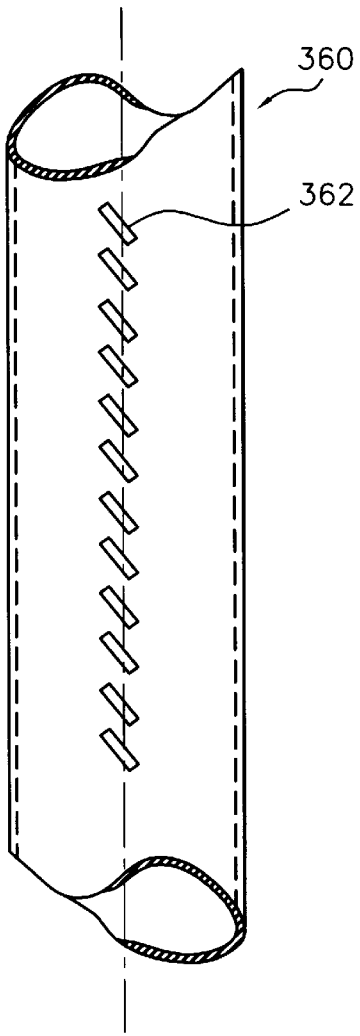
Figure 3E:
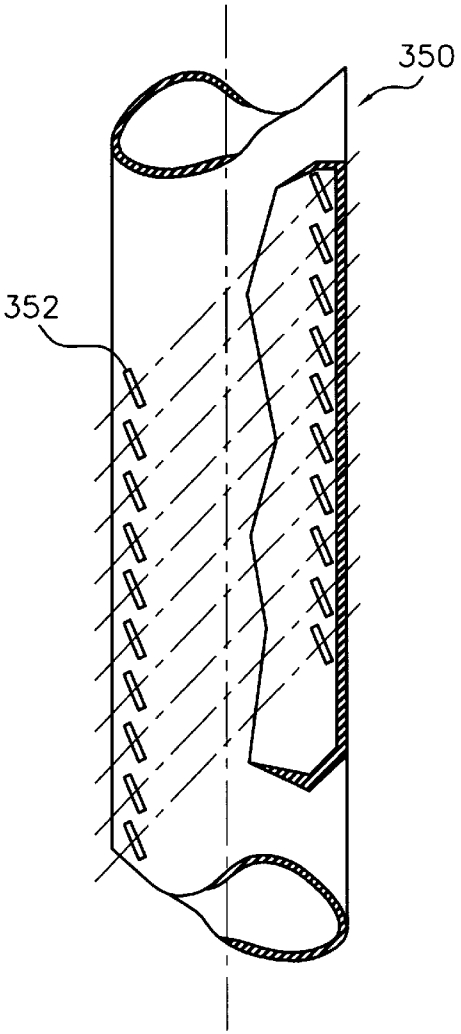
Figure 3D:
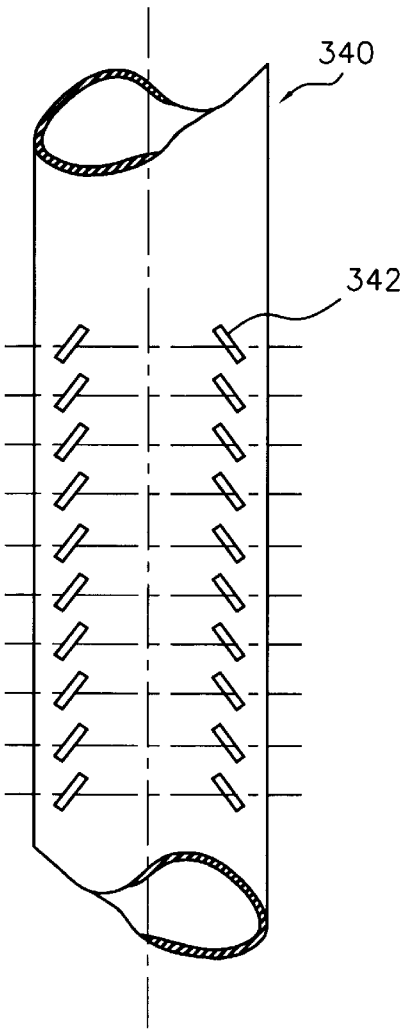
Figure 7:
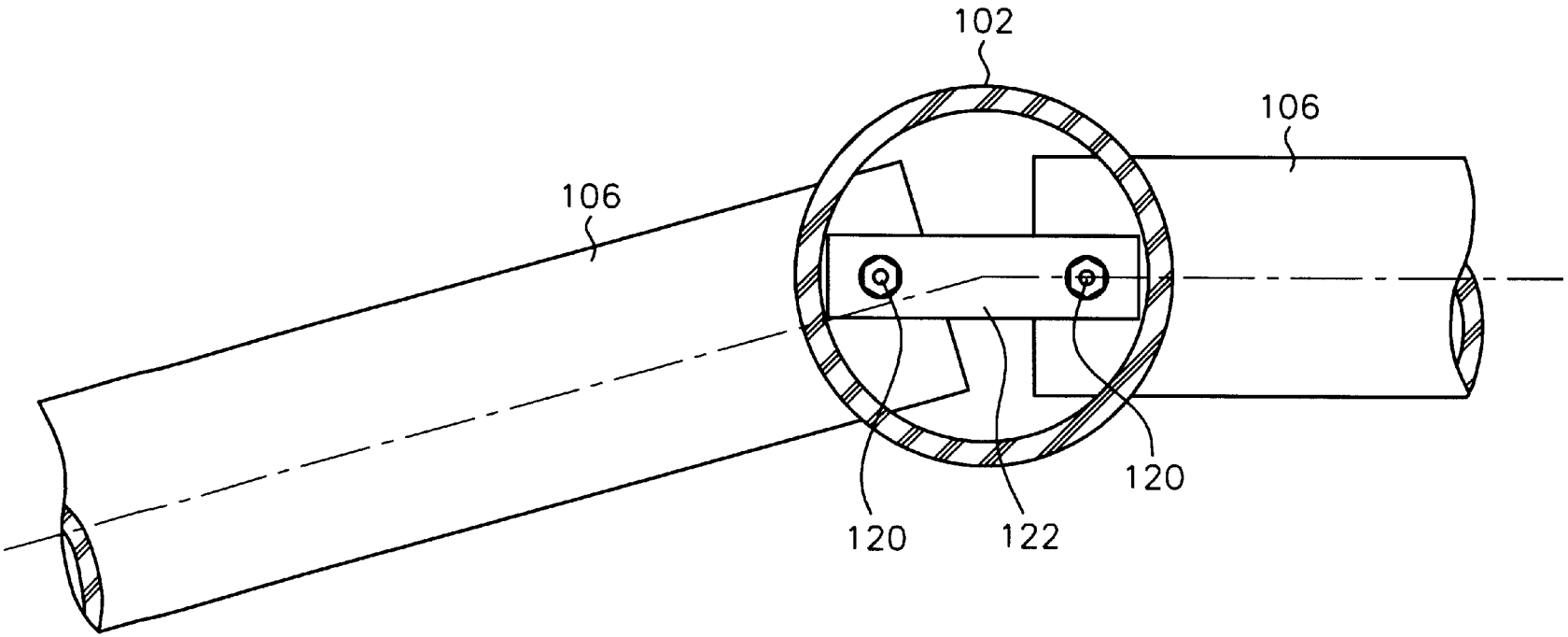
FIG. 7 is a cross-sectional end view of an intermediate post of according to yet another exemplary embodiment of the present invention.

In addition, although not shown in FIGS. 3A–3C, a post may have slots 110, 116, 118, formed in 3 sides of the post or in all sides of the post, as desired, to accommodate a variety of customer needs. Furthermore as shown in FIG. 7, if a post having a circular cross section is used, such as shown in FIGS. 3D–3F, a fence configuration where a non-orthogonal fence layout is required, such as in irregular plots, may be accommodated. As shown in FIG. 7, in the case of a circular cross section post, the coupling plate 122 may be formed with curved ends if desired to fit within the circular post 102.

Figure 4:
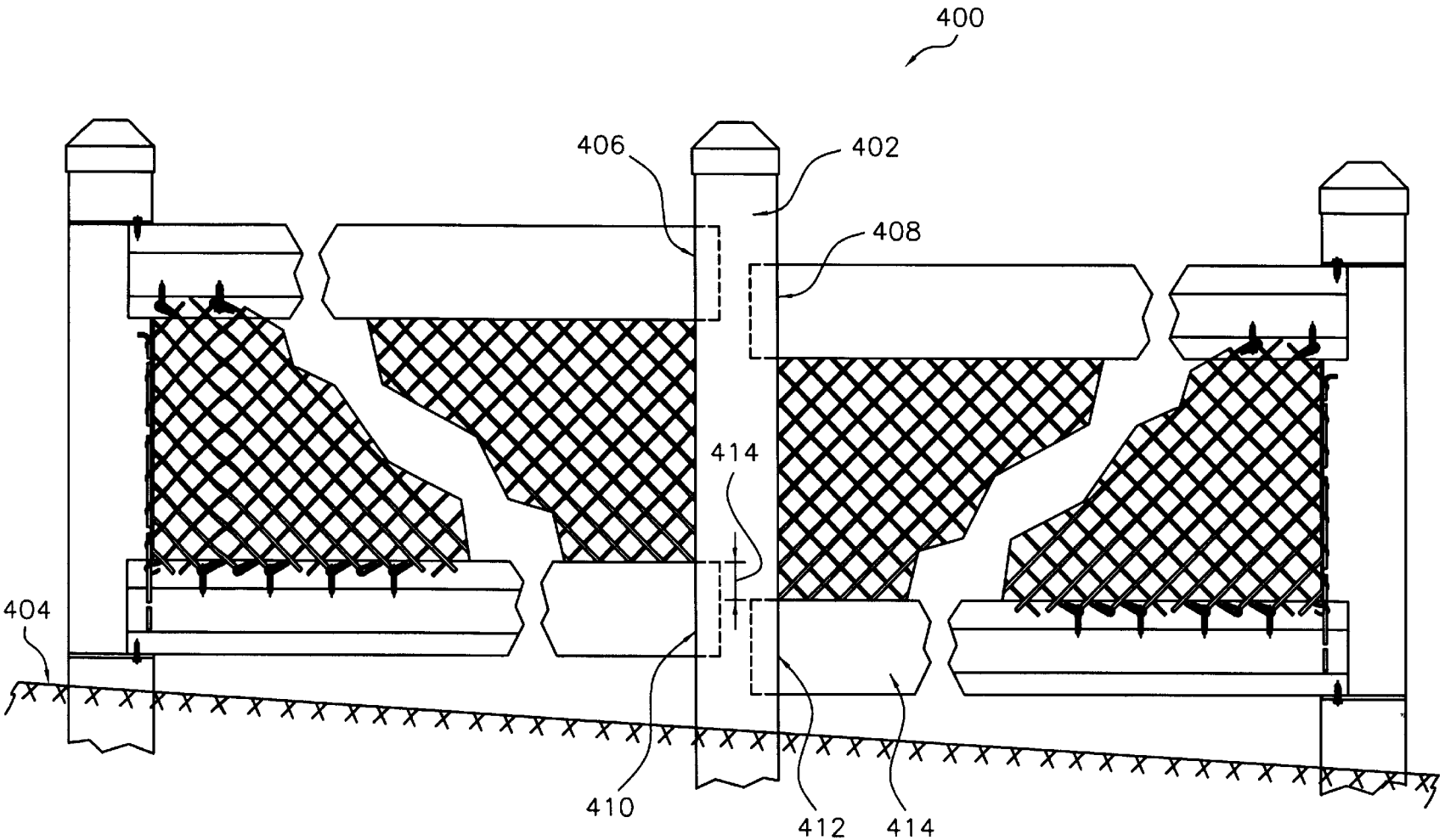
FIG. 4 is a side view of the fence according to the first exemplary embodiment adapted for a sloping grade.

Terrain that is sloped requires knowledge of the amount of grade (slope) to be accommodated so proper selection of vertical posts can be made from a range of about 1% to 25% (standard) grade, although other grades of slope may be accommodated as necessary. FIG. 4, illustrates a fence 400 that accommodates a slopped terrain.

In FIG. 4, fence 400 is installed over sloping grade 404. Post 402 has upper slots 406, 408 and lower slots 410, 412 offset from one another by a distance 414 consistent with the slope of grade 404. This arrangement of slots in post 402 preferably minimizes the space between the grade 404 and the bottom of the bottom rail 414. The result is a fence that has a stepped or tiered arrangement. In all other aspects the fence 400 is identical to the fence 100 shown in FIG. 1.

Figure 8:
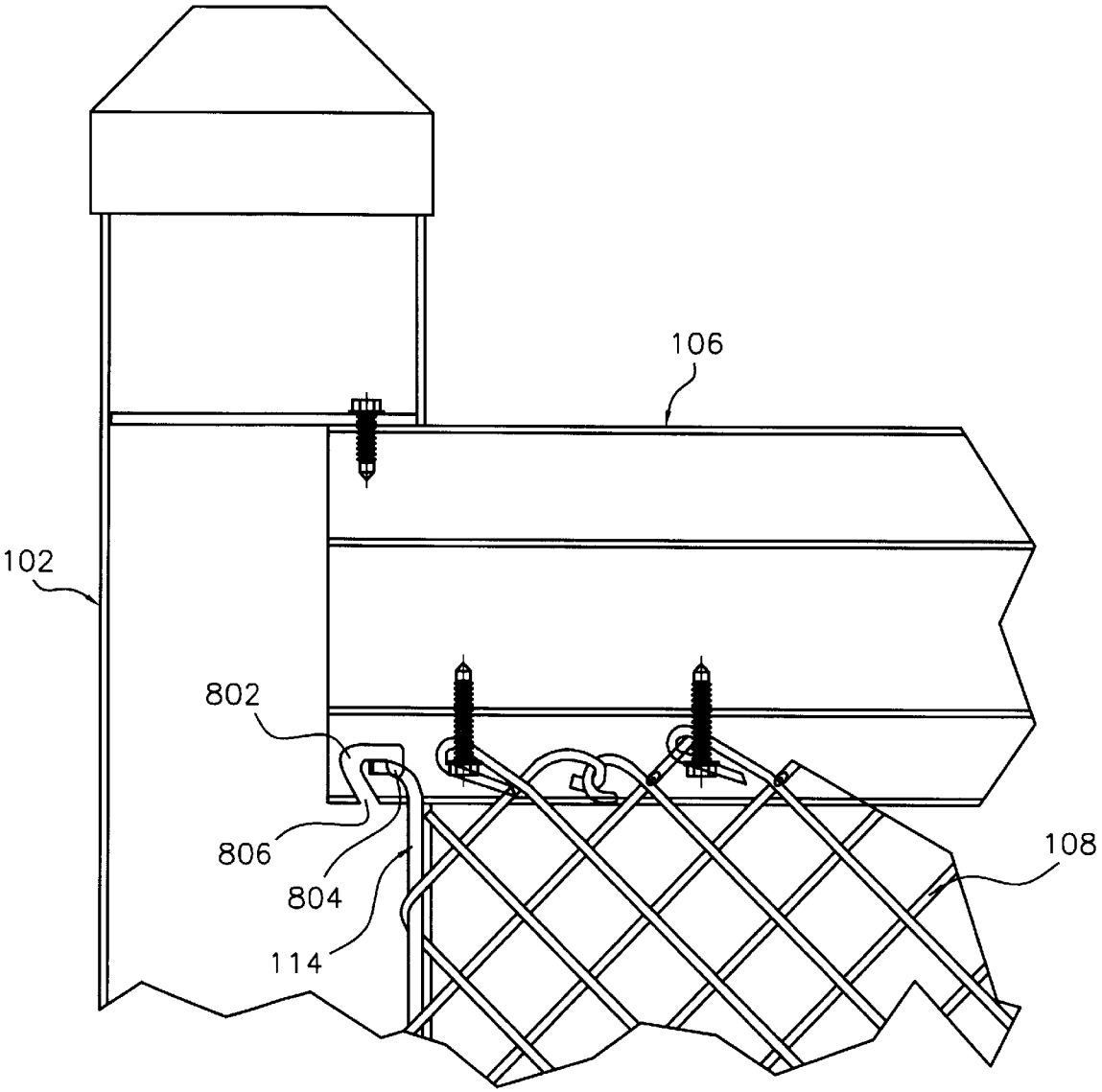
FIG. 8 is a partial side view of the fence structure according a further exemplary embodiment of the present invention.

Referring to FIG. 8, a further exemplary embodiment of the present invention is illustrated. In FIG. 8, upper cross member 106 has a notch 802 formed in an end portion of upper cross member 106. The slot 802 is formed in approximately the shape of an inverted "U" so that retainer rod 114 may engage within slot 802 through opening 806 and seat within groove 804.

As described above with respect to the first exemplary embodiment, retainer rod 114 is inserted through the top opening of the post and slides through the inside of the protruded "elbows" to retain the chain link fence to the post 102. After the upper cross member 106 is inserted into the upper slot 118 of post 102, the retainer rod 114 may be raised slightly so as to engage slot 802. The retainer rod 114 is then seated in groove 802 thereby capturing upper cross member 106 within post 102. This approach provides the benefit of greater structural integrity of the fence 100. As mentioned above, the retainer 114 may also be used to retain the lower cross member 104 to the post 102 by insertion of the rod through the top portion of lower cross member 104.

As is typical with most fence systems, entry points for an area enclosed with a fence are desirable. It is contemplated that a gate system may be added to fence 100 by forming a gate in a similar manner as disclosed above with respect to the fence 100. The gate may have similar structural elements to those of the fence 100 and scaled as required for the particular application. The gate may be attached to post 102 using conventional hinges or another means to allow the gate to open and close.

Although the invention has been described with reference to exemplary embodiments, it is not limited thereto. Rather, the appended claims should be construed to include other variants and embodiments of the invention which may be made by those skilled in the art without departing from the true spirit and scope of the present invention.

What is claimed:

1. A fence system comprising:

a first post and a second post laterally spaced from one another by a predetermined distance, each post having i) a hollow portion along a length of the post, ii) a first lower slot and a first upper slot in a first side portion of the post, the first lower slot and the first upper slot substantially parallel to the length of the post, and iii) a plurality of slots disposed between the first lower slot and the first upper slot in the first side portion of the post, the plurality of slots set at an angle with respect the length of the post;

a first cross member coupled between the first lower slot of the first post and the first lower slot of the second post;

a second cross member coupled between the first upper slot of the first post and the first upper slot of the second post, the second cross member having a further slot formed in a side portion proximate to an end thereof;

a continuous fabric extending between the first post and the second post, the fabric having a plurality of projections at a first end of the fabric and a second end of the fabric, each of the plurality of projections extending through a respective one of the plurality of slots disposed in the first post and the second post; and retainer inserted through each of the plurality of projections at least at a first end of the fabric to couple the fabric to an inside portion of at least the first post, the retainer having a hook formed at a first end thereof, wherein the hook engages the slot to i) maintain the retainer within each of the plurality of projections and ii) secure the second cross member to at least one of the first post and the second post.

2. The fence system according to claim 1, further comprising attaching means for attaching the fabric to at least one of an inside portion of the first cross member and an inside portion of the second cross member.

3. The fence system according to claim 2, wherein the attaching means is a fastener.

4. The fence system according to claim 2, wherein the attaching means is integrally formed in at least one of an upper portion and a lower portion of the fabric.

5. The fence system according to claim 1, further comprising attaching means for attaching the first cross member and the second cross member to the first post.

6. The system according to claim 5, wherein the attaching means is a fastener and a plate, the plate i) positioned over the cross member and between opposite interior walls of the post, and ii) coupled to the cross member by the fastener.

7. The system according to claim 6, wherein the fastener is at least one of a screw and a rivet.

8. The system according to claim 5, wherein the second cross member includes a slot formed in at least a first end portion of the second cross member, and the attaching means is the retainer rod, the retainer rod coupled to the slot and a top portion of the first cross member.

9. The system according to claim 1, wherein the retainer passes through a top portion of the first cross member and captures the first cross member within the post.

10. The system according to claim 1, wherein the retainer is a rod having a substantially circular cross section.

11. The system according to claim 10, wherein the retainer is one of a metallic rod, a vinyl coated metallic rod and a polymer rod.

12. The system according to claim 1, further comprising a cap positioned over a top end portion of the post.

13. The system according to claim 1, wherein at least one of the first cross member and the second cross member includes a support member disposed along a length of the respective cross member.

14. The system according to claim 1, wherein the first post includes a second lower slot and a second upper slot formed in a further side portion of the first post, said further side portion being either adjacent or opposite the first side portion of the first post, a second plurality of slots disposed between the second lower slot and the second upper slot.

15. The system according to claim 14, wherein the second lower slot and the second upper slot are laterally offset from the first lower slot and the first upper slot, respectively, by a predetermined distance.

16. The system according to claim 14, wherein the second lower slot and the second upper slot are laterally offset form the first lower slot and the first upper slot, respectively, based on a grade of an installation site.

17. The system according to claim 1, wherein the fabric is a polymer coated chain link fence material.

18. The system according to claim 1, wherein the angle of the third slots is between about 30° and 60°.

19. The system according to claim 1, wherein the angle of the third slots is between about 40° and 50°.

20. The system according to claim 1, wherein the angle of the third slots is about 45°.

21. The system according to claim 1, wherein, any one or more of the posts, first cross member, and second cross member have at least one of a substantially circular, rectangular and square cross section.

22. The system according to claim 1, wherein the first post, second post, first cross member and second cross member are a polymer material.

23. The system according to claim 1, wherein the polymer material is a rigid PVC material.

24. A method for fabricating a fence panel, the method comprising the steps of:

(a) providing a first post and a second post, each post having a hollow portion, (b) forming a lower slot and an upper slot in a side portion of the post, the lower slot and the upper slot substantially parallel to the length of the post, (c) forming a first plurality of slots disposed between the lower slot and the upper slot in the side portion of the post, the plurality of slots set at an angle with respect the length of the post, (d) coupling a first cross member between the lower slot of the first post and the lower slot of the second post, (e) extending a fence fabric between the first post and the second post, the fabric having a plurality of projections at a first end of the fence fabric and a second end of the fence fabric, (f) inserting each of the plurality of projections of the fence fabric through a respective one of the plurality of slots disposed in the first post and the second post;

(g) forming a hook at a first end of a retainer, (h) inserting the retainer through each of the plurality of projections at least the first end of the fence fabric to couple the fence fabric to an inside portion of at least the first post;

(i) forming a slot in a side portion of a second cross member proximate to an end of the second cross member, and (j) mating the hook of the retainer with the slot to couple the second cross member between the upper slot of the first post.

25. The method according to claim 24, further comprising the step (i) of attaching the fence fabric to at least one of an inside portion of the first cross member and an inside portion of the second cross member.

26. The method according to claim 24, further comprising the step of (i) coupling the second cross member to at least one of the first post and the second post with the retainer.

27. The system according to claim 1, wherein said slot is formed in a substantially inverted "U" shape.

* * * * *

UNITED STATES PATENT AND TRADEMARK OFFICE

CERTIFICATE OF CORRECTION

PATENT NO. : 6,176,471 B1
DATED : January 23, 2001
INVENTOR(S) : Naegele et al.

It is certified that error appears in the above-identified patent and that said Letters Patent is hereby corrected as shown below:

In column 8, line 18, delete "form" and insert --from--.

Signed and Sealed this

Fifth Day of June, 2001

*Attest:*

*Attesting Officer*

Nicholas P. Godici

NICHOLAS P. GODICI

*Acting Director of the United States Patent and Trademark Office*

UNITED STATES PATENT AND TRADEMARK OFFICE

CERTIFICATE OF CORRECTION

PATENT NO. : 6,176,471 B1
DATED : January 23, 2001
INVENTOR(S) : Naegele et al.

It is certified that error appears in the above-identified patent and that said Letters Patent is hereby corrected as shown below:

Column 8,
Line 18, delete "form" and insert -- from --.

Signed and Sealed this

Twenty-fourth Day of July, 2001

*Attest:*

Nicholas P. Godici

NICHOLAS P. GODICI
*Acting Director of the United States Patent and Trademark Office*

*Attesting Officer*